US007464762B2

(12) United States Patent
Duret et al.

(10) Patent No.: US 7,464,762 B2
(45) Date of Patent: Dec. 16, 2008

(54) SYSTEM FOR NEUTRALIZING THE FORMATION OF SLUGS IN A RISER

(75) Inventors: Emmanuel Duret, Rueil Malmaison (FR); Quang-Huy Tran, Rueil Malmaison (FR); Yannick Peysson, Paris (FR); Jean Falcimaigne, Bois Colombes (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 379 days.

(21) Appl. No.: 11/219,685

(22) Filed: Sep. 7, 2005

(65) Prior Publication Data

US 2006/0054327 A1 Mar. 16, 2006

(30) Foreign Application Priority Data

Sep. 13, 2004 (FR) ..... 04 09711

(51) Int. Cl.
*E21B 29/12* (2006.01)

(52) U.S. Cl. ..... 166/357; 166/368; 166/267; 137/1

(58) Field of Classification Search ..... 166/357, 166/368, 267, 266, 372; 137/1
See application file for complete search history.

(56) References Cited

U.S. PATENT DOCUMENTS 5,154,078 A * 10/1992 Codazzi ..... 73/152.22
5,232,475 A * 8/1993 Jepson ..... 95/260
5,256,171 A 10/1993 Payne
5,544,672 A * 8/1996 Payne et al. ..... 137/1
5,708,211 A * 1/1998 Jepson et al. ..... 73/861.04
6,129,150 A * 10/2000 Lima ..... 166/357
6,390,114 B1 * 5/2002 Haandrikman et al. ..... 137/2
6,543,537 B1 * 4/2003 Kjos ..... 166/266
6,668,943 B1 12/2003 Maus et al.
7,121,342 B2 * 10/2006 Vinegar et al. ..... 166/302
7,222,542 B2 * 5/2007 Eken et al. ..... 73/861.63

(Continued)

FOREIGN PATENT DOCUMENTS

DE 100 27 415 A1 12/2001

(Continued)

OTHER PUBLICATIONS

Havre, K. et al. "Active Feedback Control as the Solution to Severe Slugging" Sep. 30, 2001 pp. 1-16.

*Primary Examiner*—Thomas A Beach
(74) *Attorney, Agent, or Firm*—Antonelli, Terry, Stout & Kraus, LLP.

(57) ABSTRACT

A system inserted between the base of a riser (5) and a production well flowline for collecting an effluent consisting of at least a gas phase and a liquid phase, includes a capacity (1) including an inlet port for the effluent and two outlet ports, one in the upper part of said capacity for the gas phase, the other in the lower part for the liquid phase communicating with the base of the riser, a gas supply line (2) connecting the gas outlet port to the riser at a predetermined height H, including a flow control valve (3), and an instrumentation set for locating the level of the liquid/gas interface in the capacity, a computer receiving the instrumentation data for determining the instructions for controlling said flow control valve so as to adjust the volume of gas fed at height H into the riser.

7 Claims, 2 Drawing Sheets

U.S. PATENT DOCUMENTS

| | | | | |
|---|---|---|---|---|
| 7,239,967 | B2 * | 7/2007 | Havre | 702/50 |
| 2002/0193976 | A1 | 12/2002 | Duret | |
| 2003/0010204 | A1 | 1/2003 | Molyneux | |
| 2003/0019633 | A1 | 1/2003 | Podio | |
| 2006/0151167 | A1 * | 7/2006 | Aarvik et al. | 166/267 |

FOREIGN PATENT DOCUMENTS

| | | |
|---|---|---|
| EP | 0331295 | 2/1989 |
| EP | 0585096 | 8/1993 |
| EP | 1022429 | 7/2000 |
| EP | 1353038 | 10/2003 |

* cited by examiner

SYSTEM FOR NEUTRALIZING THE FORMATION OF SLUGS IN A RISER

FIELD OF THE INVENTION

The present invention relates to a system for neutralizing slugs or liquid accumulations at the foot of a pipe portion greatly inclined to the horizontal or riser, connected to a line intended to carry circulating multiphase fluids such as hydrocarbons, by controlled introduction of gas taken from the circulating fluids.

BACKGROUND OF THE INVENTION

In order to make deep-sea reservoirs or marginal fields sufficiently profitable, oil companies have to develop new production techniques, as economic as possible. It is therefore more advantageous to directly transport the two-phase mixture consisting of liquid (oil and often water) and gas within a single line, or pipeline, to a shallow-water processing platform or even to onshore facilities in order to be separated. A pipe portion greatly inclined to the horizontal (often close to the vertical), referred to as riser by specialists, and which is connected to the deep-sea flowline, is used therefore. However, the gas and the liquid being transported together, flow instability phenomena may occur in the riser connection zone and lead to serious production problems.

In particular, when the gas and liquid flow rates at the inlet are low, the liquid phase accumulates at the lowest points of the pipe and prevents the gas from flowing past. The upstream pressure increases and eventually expels the liquid slug. These accumulation phenomena can reduce the productivity and fill the pipes and equipments intended to receive gas with liquid, downstream from the separators. One of these phenomena, more commonly known to specialists as "severe slugging", was subjected to many studies, either experimental using test loops, or by simulation with simulation softwares such as, for example, the TACITE simulation code which is notably the subject of the following patents or patent applications: U.S. Pat. No. 5,550,761, FR-2,756,044 (U.S. Pat. No. 6,028,992) and FR-2,756,045 (U.S. Pat. No. 5,960,187), FR-00/08,200 and FR-00/09,889 filed by the applicant.

A technique known to specialists as gas lift allows this phenomenon to be overcome. It essentially consists in permanently injecting gas at the base of the riser to prevent liquid accumulation at the bottom of the riser. If this phenomenon cannot be properly controlled, large amounts of gas have to be injected in most cases, which requires considerable compression means. Furthermore, injection of large amounts of gas changes the gas/oil ratio (GOR), which complicates the phase separation operations at the top of the riser.

SUMMARY OF THE INVENTION

The present invention thus relates to a system inserted between the base of a riser and a production well flowline intended for collection of an effluent consisting of at least a gas phase and a liquid phase, comprising:

- a capacity including an inlet port for the effluent and two outlet ports, one in the upper part of said capacity for the gas phase, the other in the lower part for the liquid phase communicating with the base of the riser,
- a gas supply line connecting the gas outlet port to the riser at a predetermined height H, comprising a flow control valve,
- an instrumentation set for locating the level of the liquid/gas interface in the capacity,

- a computer receiving the instrumentation data for determining the instructions for controlling said flow control valve so as to adjust the volume of gas fed at height H into the riser, and jointly the liquid/gas interface level.

The instrumentation set can include at least two pressure detectors, one for the gas pressure and the other at the liquid outlet.

The computer can determine the volume of gas introduced by taking account of the flow rate variation of the gas phase and/or of the liquid phase.

A bypass line connects the flowline to the riser without passing through the capacity.

The principal axis of said capacity can be close to the vertical and the axis of the riser can substantially merge with the axis of the capacity.

Height H is preferably at least greater than 90 m.

The present invention advantageously applies to the control of severe slugging type slugs at the base of a riser.

BRIEF DESCRIPTION OF THE FIGURES

Other features and advantages of the present invention will be clear from reading the description hereafter of non limitative embodiment examples, with reference to the accompanying figures wherein.

DETAILED DESCRIPTION

Figure 1:
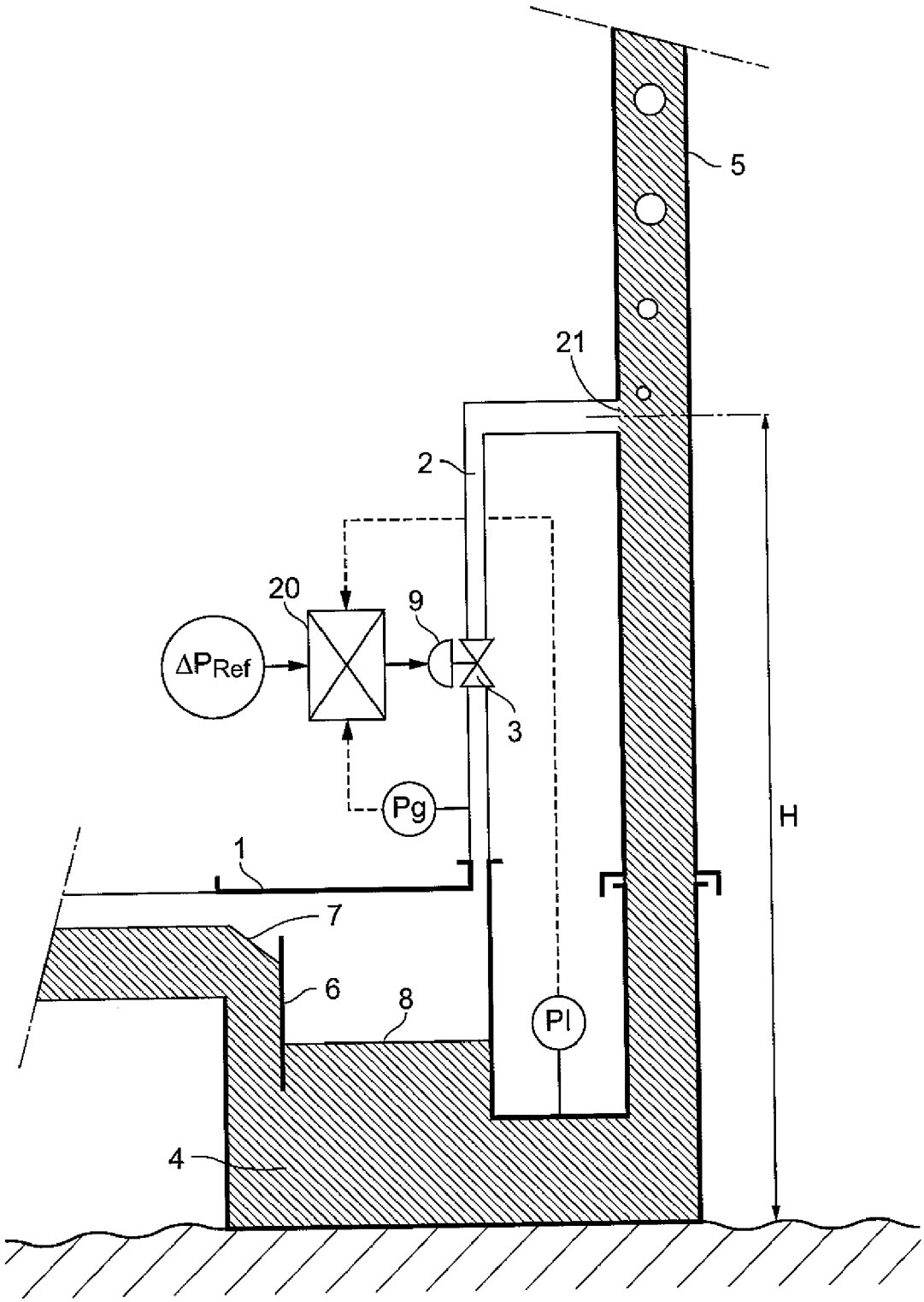
FIG. 1 diagrammatically shows the structure of the present invention.

FIG. 1 shows a capacity 1 whose primary function is to allow relatively coarse separation of the gas and of the liquid phases. The gas, collected in the upper part of the capacity, is discharged through a secondary line 2 equipped with a control valve 3. The liquid phases (possibly containing some entrained solid particles such as sand) are discharged in the lower part 4 of the capacity. The gas and the liquid phases are then recombined in riser 5 through inlet 21 into which secondary line 2 opens. This inlet is located at a height H from the base of the riser where the slugs appear. This height is determined considering the environment, the effluent production conditions, so that the hydrostatic column lightening action (gas lift) created by feeding the gas into the liquid column in the riser can stabilize the regulation loop of the system by controlling flow control valve 3. In fact, it is clear to the man skilled in the art that too limited a height cannot allow effective flow control.

The separation is referred to as "coarse" because, according to the invention, perfect separation of the gas and of the liquid phases is not sought, but the tolerances relative to the flow of gas carried along towards the liquid phase outlet or the flow rate of liquid droplets carried towards the gas outlet can be less severe than those commonly prescribed for phase separation.

The main criterion is that the liquid streams carried along by the gas do not disturb operation of the control system of valve 3, and more precisely that the pressures measured by the instrumentation described below, because of the mean apparent densities of the gas comprising liquid particles and gas-containing liquid, do not lead to a significant error in the calculated position of the gas/liquid interface.

Consequently, dimensioning of capacity 1 of the system, expressed according to the practice of the man skilled in the art, in liquid phase retention time, is not very constraining. This retention time depends on the viscosity of the liquid phases at the pour-point temperature according to formulas known to the man skilled in the art, but it can be of the order of one to some minutes. It is not necessary to provide in the separation capacity the complex internal equipments that are often used to improve the separation efficiency, such as coalescence plates. Only an anti-splash plate 6 can be arranged before fluid inlet 7 to limit agitation at gas/liquid interface 8. An inner water jet cleaning device (not shown) consisting of a line provided with nozzles can be added if the nature of the effluent points to the possibility of solid deposits.

The function of the separation capacity also makes it allowable for gas to temporarily flow out through the liquid phase outlet and for liquid to flow out of the gas outlet. It is therefore not necessary to provide an instrumentation for controlling the gas/liquid interface level, or high or low level alarms with stop leading to closure of the line or of the wells in case the alarm threshold is exceeded. The inner gas/liquid interface level can therefore fluctuate within the extent of the capacity height.

Dimensioning of the volume of this capacity mainly depends on the size of the successive liquid and gas slugs which translate into fluctuations of the interface level, that the system has to accept under standard operating conditions. The size of these slugs essentially depends on the configuration of the line upstream from the capacity, notably on the existence of low points allowing liquid accumulation, and on the flow characteristics of the wells. Flow simulation surveys carried out with a software such as that mentioned above allow the size of the slugs to be evaluated.

The outer casing of the separation capacity can have any shape, but it preferably consists of a cylindrical part ending in two hemispherical or elliptical bottoms in order to best withstand the hydrostatic pressure exerted by the outside marine environment, and the internal pressure of the petroleum effluent. The capacity can be arranged with the axis of the cylinder arranged horizontally (FIG. 2*a*) or vertically (FIG. 2*b*).

The inner geometry of the capacity is designed to prevent low flow rate fluid zones favorable to solid particles, notably sand, deposition. To prevent such deposition, the effluent has to be accelerated close to the liquid phase outlet. A hopper-shaped geometry of progressively variable section is particularly advantageous. Such a shape is particularly suitable for a vertically arranged capacity.

Figure 2A:
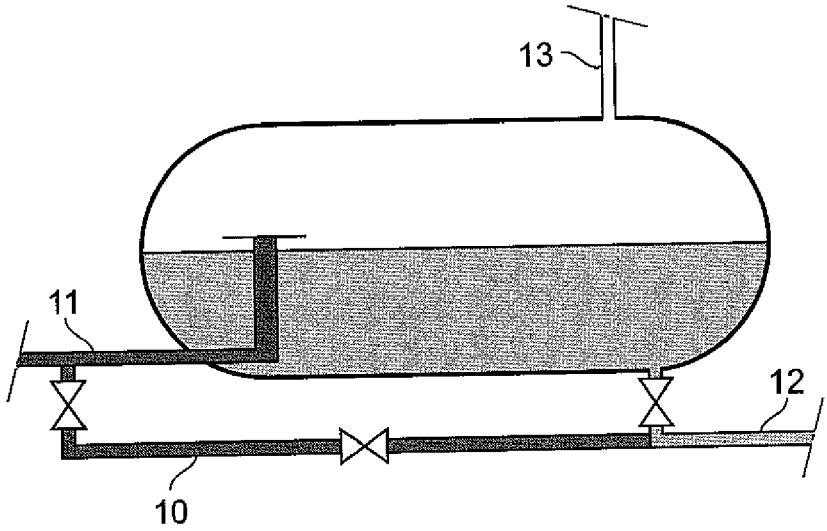
FIGS. 2*a* and 2*b* show two embodiment examples.
Figure 2B:
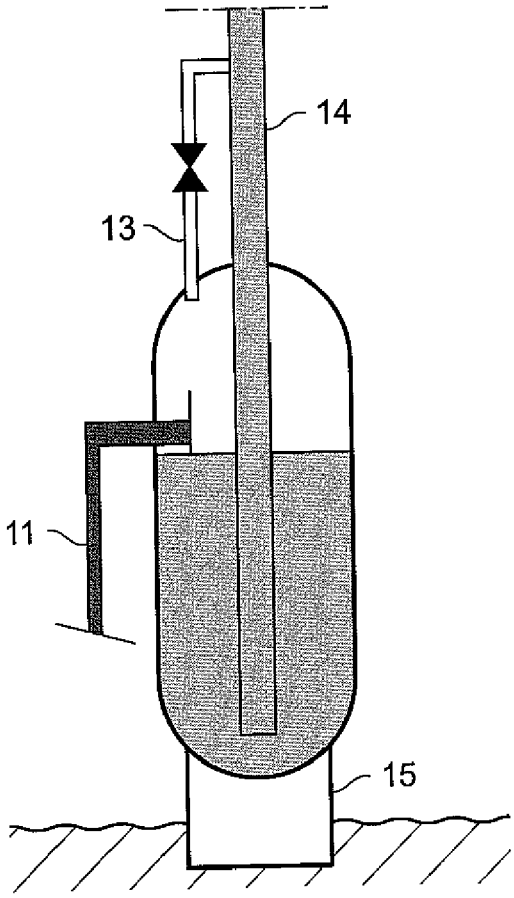

It can be advantageous to install a bypass line 10 bypassing the separation capacity in case of sanding up or dismantling for repair or maintenance (FIG. 2*a*). These valves can be operated by a ROV (remotely-operated subsea vehicle). Line 11 is connected to the production wellheads, line 12 is connected to the base of the production riser, line 13 corresponds to the line feeding the gas into the riser.

The capacity can be arranged near to the base of the riser on the baseplate of the riser or at a short distance therefrom, on an independent baseplate. In this case, the junctions of the lines between the capacity and the riser consist of connecting devices known to specialists as jumpers.

According to the architecture diagrammatically illustrated in FIG. 2*b*, it is also possible to arrange the capacity in such a way that it forms a vertical continuation of riser 14, and to directly connect the riser to the capacity. In this case, foundation 15 of the separation capacity also acts as an anchor for the riser.

Control valve 3 is intended to control the gas flow rate in the riser. The type of valve and its dimensions are determined according to the nominal gas flow rate and to the pressure drop required for this nominal flow rate. Since the fluid flowing therethrough is wet gas, with high-velocity liquid droplets, it may undergo wear through erosion of the metal. The layout of this valve is suited to allow easy servicing for replacement of its inner parts. It can therefore be advantageously placed on the capacity.

Actuator 9 of valve 3 can be hydraulic or electric, thus involving either an electric cable or a hydraulic umbilical. These configurations are known from the state of the art.

Since the gas injection point on the riser can be located at a rather great height above the control valve, injection line 13 can be fastened along the riser, outside or inside it.

Computer 20 (FIG. 1) for determining instructions for the valve actuator is arranged at the surface, and it receives the measurements from instrumentation Pl and Pg through any known means: for example a cable or radio transmission.

The instrumentation is preferably duplicated to provide redundancy, and installed vertically to facilitate replacement operations. It is ideally installed in the separation capacity, thus simplifying maintenance operations. In fact, the controller tries to position the gas/liquid interface in the separator at a certain reference height, which is equivalent to causing the pressure difference between the two detectors to tend towards reference value $\Delta$Pref. It is limited to pressure measuring instruments, and pressure transmitters are available for water depths of at least 2500 m.

The actuator controller is of Proportional/Integral type allowing fast proportional response to stabilize the interface at a certain height, then the Integral function slowly stabilizes this interface at the reference height.

The point of introduction of the gas in the riser (height H according to FIG. 1) is determined, as well as the value of the coefficients of the actuator controller.

We first integrate in space the physical laws of mass conservation of each phase and of the momentum to obtain an algebro-differential type model similar to the model described by Taitel in his article "Stability of Severe Slugging", Int. J. Multiphase Flow, 12 (1986), pp. 203-217, and depending on the system characteristics, in particular the geometry of the pipes and lines, the pressure of the effluent at the production wellhead outlet, the flow rates and the mean densities of each phase, the vertical height of the riser.

We then use the conventional Automation techniques and laws to seek stability of this type of system, and we deduce the relations giving the minimum height H of the gas introduction point, and the optimum coefficient values of controller PI, allowing to generate an instruction that stabilizes the position of the gas/liquid interface.

For conventional oil and gas production conditions, we determined that the height H of the injection point has to be greater than at least 90 m, for a water depth crossed by the riser of about 500 m, about 170 m for a water depth of about 1000 m, about 240 m for a water depth of about 1500 m, and about 320 m for a water depth of about 2000 m.

It can also be noted that this system does not disturb flow when not under severe slugging conditions, and it can then be either operating or stopped by closing the valve.

The invention claimed is:

1. A system inserted between the base of a riser and a production well flowline for collecting an effluent consisting of at least a gas phase and a liquid phase, comprising:

a capacity including an inlet port for the effluent, a gas outlet port in the upper part of said capacity for the gas phase, and a liquid outlet in the lower part for the liquid phase communicating with the base of a riser, a gas supply line connecting the gas outlet port to the riser at a predetermined height H, comprising a flow control valve, an instrumentation set for locating the level of the liquid/gas interface, a computer receiving the instrumentation data for determining the instructions for controlling said flow control valve so as to adjust the volume of gas fed at height H into the riser.

2. A system as claimed in claim 1, wherein the instrumentation set comprises at least two pressure detectors, one for the gas pressure, the other at the liquid outlet.

3. A system as claimed in claim 1, wherein the computer determines the volume of gas introduced by taking account of the flow rate variation of the gas phase and/or of the liquid phase.

4. A system as claimed in claim 1, wherein a bypass line connects the flowline to the riser.

5. A system as claimed in claim 1, wherein the principal axis of said capacity is close to the vertical, and the axis of the riser substantially merges with the axis of the capacity.

6. A system as claimed in claim 1, wherein height H is at least greater than 90 m.

7. A method, comprising inserting the system as claimed in claim 1 between the base of a riser and a production well flowline, and operating the system to the control of severe slugging type liquid slugs at the base of a riser.

* * * * *